United States Patent [19]

Aoyagi

[11] Patent Number: 5,048,293

[45] Date of Patent: Sep. 17, 1991

[54] PUMP CONTROLLING APPARATUS FOR CONSTRUCTION MACHINE

[75] Inventor: Yukio Aoyagi, Ibaraki, Japan

[73] Assignee: Hitachi Construction Machinery Co., Ltd., Tokyo, Japan

[21] Appl. No.: 454,387

[22] Filed: Dec. 21, 1989

[30] Foreign Application Priority Data

Dec. 29, 1988 [JP] Japan ..... 63-333621

[51] Int. Cl.[5] ..... E02F 9/22

[52] U.S. Cl. ..... 60/420; 60/427; 60/428; 60/452

[58] Field of Search ..... 60/450, 452, 420, 426, 60/428, 427

[56] References Cited

U.S. PATENT DOCUMENTS

| | | | |
|---|---|---|---|
| 4,523,430 | 6/1985 | Masuda | 60/452 X |
| 4,531,366 | 7/1985 | Moriya et al. | 60/428 X |
| 4,617,854 | 10/1986 | Kropp | 91/517 |
| 4,715,788 | 12/1987 | Kouns et al. | 60/452 X |
| 4,738,102 | 4/1988 | Kropp | 60/452 X |
| 4,809,504 | 3/1989 | Izumi et al. | 60/444 X |
| 4,838,756 | 6/1989 | Johnson et al. | 60/452 X |
| 4,934,143 | 6/1990 | Ezell et al. | 60/452 X |

FOREIGN PATENT DOCUMENTS

| | | |
|---|---|---|
| 104613 | 4/1984 | European Pat. Off. . |
| 309987 | 4/1989 | European Pat. Off. . |

*Primary Examiner*—Edward K. Look
*Assistant Examiner*—George Kapsalas
*Attorney, Agent, or Firm*—Fay, Sharpe, Beall, Fagan, Minnich & McKee

[57] ABSTRACT

A hydraulic drive controlling apparatus for a construction machine has at least one variable displacement type hydraulic pump, a plurality of actuators driven with a hydraulic fluid from the hydraulic pump, directional control valves driven in accordance with amounts of manipulation of operation means for controlling the plurality of actuators, means for detecting a delivery pressure of the hydraulic pump, means for selecting maximum one of load pressures of the plurality of actuators, and first control means for controlling displacement of the hydraulic pump to bring a differential pressure between the delivery pressure and the maximum load pressure to a specified value. The hydraulic drive controlling apparatus further has second control means for controlling the displacement of the hydraulic pump to bring the delivery pressure thereof to a predetermined value, first command means for selecting a mode of control of the displacement of the hydraulic pump and outputting a corresponding command signal, and first selection means for selecting one of the first and the second control means depending upon the command signal from the first command means.

17 Claims, 4 Drawing Sheets

PUMP CONTROLLING APPARATUS FOR CONSTRUCTION MACHINE

BACKGROUND OF THE INVENTION

The present invention relates to an apparatus for controlling the hydraulic drive of a construction machine and, more particularly to a hydraulic drive controlling apparatus with a load sensing system, which controls the capacity or displacement of a hydraulic pump or pumps in a construction machine, e.g. a hydraulic excavator and the like, in such a manner that the discharge or delivery pressure of the hydraulic pumps becomes higher by a fixed value than the maximum one of load pressures of plural actuators.

A construction machine, for instance a hydraulic excavator, is equipped with one or a plurality of hydraulic pumps. Actuators of the machine, such as a boom cylinder, an arm cylinder, bucket cylinders, a swing motor, left and right traveling motors, etc., are driven with the hydraulic fluid delivered from these hydraulic pumps. A directional control valve is provided between each actuator and the hydraulic pumps. Operator's manipulation of a control lever for each actuator at his discretion, which control lever is provided in an operator's cabin of the hydraulic excavator, operates the corresponding directional control valve responsively. The thus operated directional control valve controls the flow of the hydraulic fluid from the hydraulic pumps to the actuator, and hence the movement thereof is controlled to perform an expected operation of the hydraulic excavator.

Various systems have been proposed for the drive control of such actuators. Typical one of the thus proposed is the load sensing system shown in JP-A-60-11706 which corresponds to U.S. Pat. No. 4,617,854. This load sensing system is adapted to control the displacement of the hydraulic pumps during the drive control of the actuators so that the delivery pressure of the hydraulic pumps is kept higher by a fixed value than the maximum one of load pressures of the actuators. By virtue of this control, the actuators are driven with the minimum delivery of the hydraulic pumps to enable an economical operation.

As described above, the load sensing system is extremely superior as a hydraulic drive controlling apparatus for a construction machine. This system, however, can not control the driving pressure of each actuator in response to the corresponding control lever. Accordingly, in a certain case, for instance, when the load sensing system is employed in the drive control of an actuator for moving a member of large inertia, the following inconvenience or disadvantage arises.

That is, when it is desired to slowly accelerate the swing motor for driving a swing body of a hydraulic excavator, which body is of large inertia, even a slight amount of manipulation of the corresponding control lever causes the delivery pressure of the hydraulic pumps to abruptly increase until the load pressure of the swinging motor reaches a relief pressure for the swinging. This is because the control of the pump displacement is done so as to increase the delivery pressure of the hydraulic pumps by a fixed value as compared with the load pressure of the swing motor. As a result, the high relief pressure is applied to the swing motor, and the same is suddenly accelerated, despite the manipulation for a slow acceleration, to make a different motion from operator's intention. Such motion is quite dangerous. In addition, a large quantity of the hydraulic fluid is relieved, resulting in a large loss of power.

Similar phenomena arise in the case of the other actuators. One example given here among many operations of the hydraulic excavator is the operation of softly pressing its bucket against dug portions of the ground to level the same. Also in this operation, as the driving pressure can not be adjusted, the working member is brought to press rather hard against the ground, making it difficult to perform the desired working while causing a great loss in power.

It is an object of the present invention to provide a hydraulic drive controlling apparatus for a construction machine, which is capable of adjusting the driving pressures of actuators of the machine, while making efficient use of the load sensing system's merits, to enable the actuators to do expected motions.

SUMMARY OF THE INVENTION

To attain the object described above, according to the invention, there is provided a hydraulic drive controlling apparatus for a construction machine which has at least one variable displacement type hydraulic pump, a plurality of actuators driven with a hydraulic fluid from the hydraulic pump, directional control valves driven in accordance with amounts of manipulation of operation means for respectively controlling the plurality of actuators, means for detecting a delivery pressure of the hydraulic pump, means for selecting a maximum one of load pressures of the plurality of actuators, and first control means for controlling displacement of the hydraulic pump to bring a differential between the delivery pressure and the maximum load pressure to a specified value. The hydraulic drive controlling apparatus is further provided with second control means for controlling the displacement of the hydraulic pump to bring the delivery pressure thereof to a predetermined value, first command means for selecting a mode of control of the displacement of the hydraulic pump and outputting a corresponding command signal, and first selection means for selecting one of the first and the second control means depending upon the command signal from the first command means.

In the apparatus thus constructed in accordance with the present invention, when the output from the first command means is the command signal of selecting a control mode to be done by the first control means, the first selection means selects the first control means. The first control means controls the displacement of the hydraulic pump so as to bring the differential pressure between the delivery pressure and the maximum load pressure to the specified value. Namely, the essential control of the load sensing system is performed. On the other hand, in case that the output from the first command means is the command signal of selecting a control mode to be done by the second control means, the first selection means selects the second control means. The second control means controls the displacement of the hydraulic pump so as to bring the delivery pressure thereof to the predetermined value. That is, the pump displacement is controlled in a pressure control mode. Consequently, the driving pressure of the actuators is controlled correspondingly, and therefore the acceleration or a pressing force of each actuator is brought under control.

It is preferable that the apparatus of the present invention further has second selection means. The second selection means judges whether the operation means for specific one of the actuators is manipulated, and selects the second control means when the operation means for the specific actuator is manipulated, and the first control means when the operation means for the other actuators are manipulated. With the provision of this additional means, the control of the pump displacement in the pressure control mode is carried out solely for the specific actuators.

The second control means may include first setting means for setting a target pressure which increases as the amounts of manipulation of the operation means increases. The second control means obtains the target pressure corresponding to the manipulation amounts from the first setting means to provide the predetermined value. With this arrangement, when the pump displacement is controlled in the pressure control mode, a pump delivery pressure is set according to the manipulation amounts of the operation means. Consequently, the driving pressure or pressing force of each actuator can be controlled in proportion to the manipulation amount of the corresponding operation means.

Further, the second control means may include second setting means for setting a fixed target pressure which provides the predetermined value.

Moreover, the apparatus of the invention may have second command means for selecting a target value for the delivery pressure of the hydraulic pump and outputting a corresponding command signal, and the second control means may include third setting means for setting a target pressure which varies depending upon the command signal from the second command means. The second control means obtains the target pressure corresponding to the command signal from the third setting means to provide the predetermined value. With this arrangement, the operator can set a pump delivery pressure at his discretion when controlling the pump displacement in the pressure control mode.

DETAILED DESCRIPTION OF THE PREFERRED EMBODIMENTS

The present invention will be described hereinafter with reference to the embodiments shown in the accompanying drawings.

Figure 1:
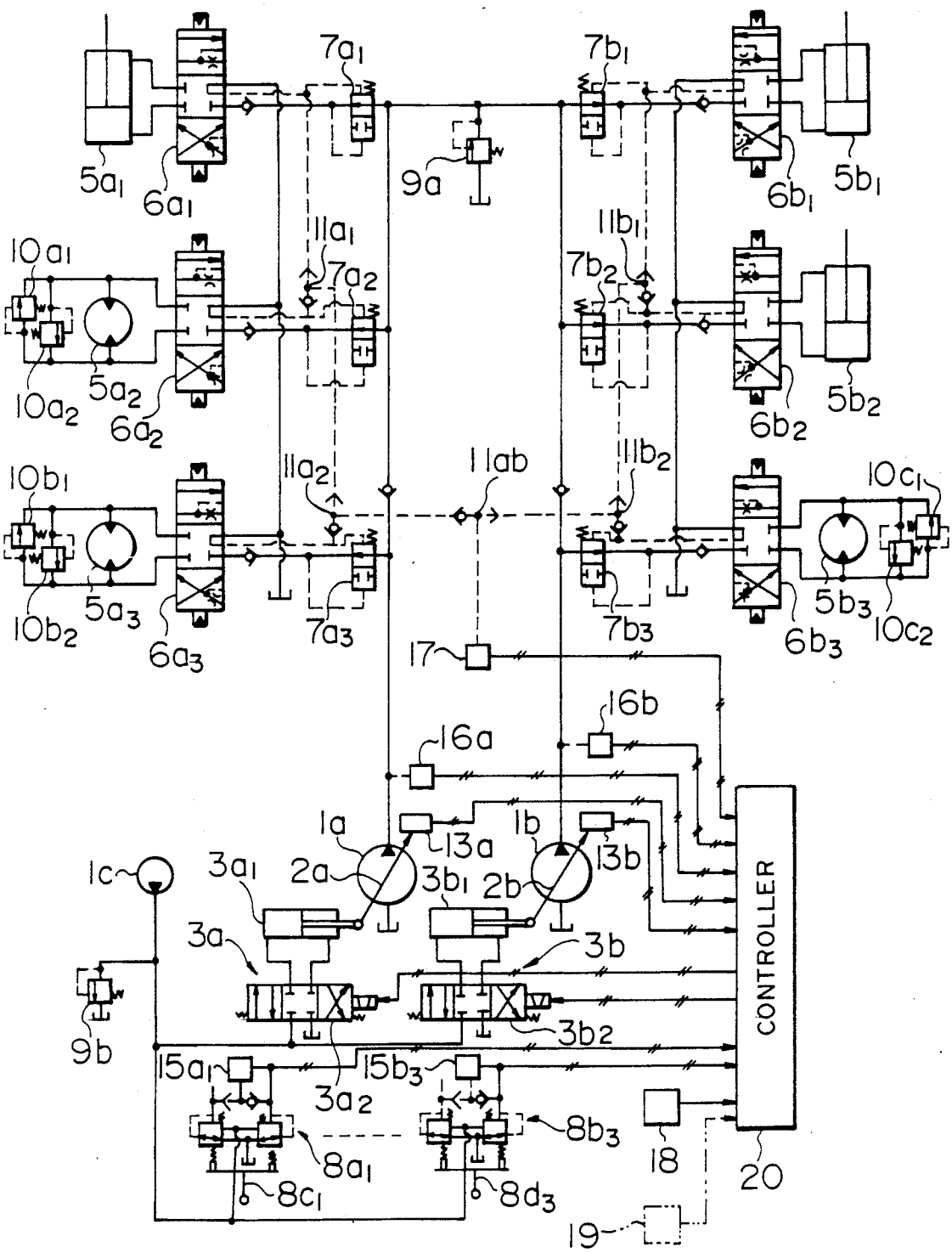
FIG. 1 is a system diagram of the hydraulic drive controlling apparatus for a hydraulic excavator in accordance with an embodiment of the invention.

In FIG. 1 which shows the hydraulic drive controlling apparatus for a hydraulic excavator in accordance with the first embodiment of the invention, reference numerals 1*a*, 1*b* denotes two variable displacement type main hydraulic pumps, respectively, which are mounted on the hydraulic excavator, and reference numeral 1*c* denotes a constant displacement type auxiliary hydraulic pump which supplies a secondary hydraulic fluid such as a pilot hydraulic fluid and the like. The hydraulic pumps 1*a*, 1*b* have displacement volume varying mechanisms 2*a*, 2*b*, respectively, which will be hereinafter referred to as swash plates for short. The swash plates 2*a*, 2*b* are operated through pump displacement control mechanisms 3*a*, 3*b*, respectively. The pump displacement control mechanisms 3*a*, 3*b* comprise cylinders $3a_1$, $3b_1$ which are connected to the respective swash plates 2*a*, 2*b*, and control valves $3a_2$, $3b_2$ for controlling the driving of the cylinders $3a_1$, $3b_1$, respectively.

The hydraulic fluid delivered from the hydraulic pumps 1*a*, 1*b* is fed to actuators $5a_1$, $5a_2$, $5a_3$, $5b_1$, $5b_2$ and $5b_3$ so as to drive them. Describing these actuators concretely, the actuator $5a_1$ is a boom cylinder, the actuators $5a_2$, $5a_3$ are left and right traveling motors, respectively, the actuators $5b_1$, $5b_2$ are an arm cylinder and a bucket cylinder, respectively, and the actuator $5b_3$ is a swing motor. The amounts and directions of flows of the hydraulic fluid fed to the actuators $5a_1$, $5a_2$ and $5a_3$ are respectively controlled by directional control valves $6a_1$, $6a_2$ and $6a_3$, and those to the actuators $5b_1$, $5b_2$ and $5b_3$ are respectively controlled by directional control valves $6b_1$, $6b_2$ and $6b_3$. Pressure compensating valves $7a_1$, $7a_2$, $7a_3$, $7b_1$, $7b_2$ and $7b_3$ are disposed on the upstream sides of the directional control valves $6a_1$, $6a_2$, $6a_3$, $6b_1$, $6b_2$ and $6b_3$, respectively, each of which pressure compensating valves controls a differential hydraulic pressure across the corresponding directional control valve to a fixed value.

Provided in connection with the directional control valves $6a_1$–$6b_3$ are hydraulic pilot valves $8a_1$, $8a_2$, $8a_3$, $8b_1$, $8b_2$ and $8b_3$ which are operated by means of control levers $8c_1$, $8c_2$, $8c_3$, $8d_1$, $8d_2$, and $8d_3$, respectively. Each of the hydraulic pilot valves exert a pilot pressure on a pilot port of a corresponding one of the directional control valves $5a_1$–$5b_3$ to drive the same, which pilot pressure is in proportion to an amount and a direction of manipulation of the corresponding control lever.

The hydraulic fluid from the main pumps 1*a*, 1*b* is delivered into a main circuit, and that from the auxiliary pump 1*c* into a pilot circuit. Relief valves 9*a*, 9*b* are provided in the main and the pilot circuit to regulate the maximum pressures thereof, respectively. Additionally, the traveling motor $5a_2$ is provided with relief valves $10a_1$, $10a_2$, the other traveling motor $5a_3$ is provided with relief valves $10b_1$, $10b_2$, which relief valves regulate the maximum pressure for the traveling, and the swing motor $5b_3$ is provided with relief valves $10c_1$, $10c_2$ which regulate the maximum pressure for the swinging.

Shuttle valves $11a_1$, $11a_2$, $11b_1$, $11b_2$ and 11*ab* are connected to the directional control valves as shown in the figure. The shuttle valve $11a_1$ selects a higher one of the load pressures of the actuators $5a_1$, $5a_2$. The shuttle valve $11a_2$ selects a higher one of the selected pressure by the shuttle valve $11a_1$ and the load pressure of the actuator $5a_3$. The shuttle valve $11b_1$ selects a higher one of the load pressures of the actuators $5b_1$, $5b_2$. The shuttle valve $11b_2$ selects a higher one of the selected pressure by the shuttle valve $11b_1$ and the load pressure of the actuator $5b_3$. The shuttle valve 11*ab* selects a higher one of the pressures selected by the shuttle valves $11a_2$, $11b_2$. Consequently, the highest or maximum one of the load pressures of the actuators $5a_1$–$5b_3$ is selected by the shuttle valve 11*ab*.

In the hydraulic circuits constructed as above, a group of sensors is provided. These sensors include pump displacement detectors 13*a*, 13*b* for respectively detecting amounts of tilting of the swash plates 2*a*, 2*b* which represent the displacements of the hydraulic pumps 1*a*, 1*b*, and operation command detectors 15*a*-

$_1$-15$b_3$ for respectively detecting the pilot pressures output from the hydraulic pilot valves 8$a_1$-8$b_3$ as the amounts of manipulation of the control levers 8$c_1$-8$8_3$. Further included in the sensors are delivery pressure detectors 16*a*, 16*b* for detecting the respective delivery pressures of the hydraulic pumps 1*a*, 1*b*, and load pressure detector 17 for detecting the maximum pressure selected by the shuttle valve 11*ab*. In addition, selection commander 18 adapted to be controlled or operated by an operator is provided for selecting one of a normal load sensing control mode and a specific pressure control mode in which the hydraulic pumps 1*a*, 1*b* are to be controlled. The detection signals from the group of sensors and the command signal from the selection commander 18 are inputted into a controller 20 in which necessary operation is carried out on the basis of these signals to output a resultant command signal to the control valves 3$a_2$, 3$b_2$ of the pump displacement control mechanisms 3*a*, 3*b*.

Figure 2:
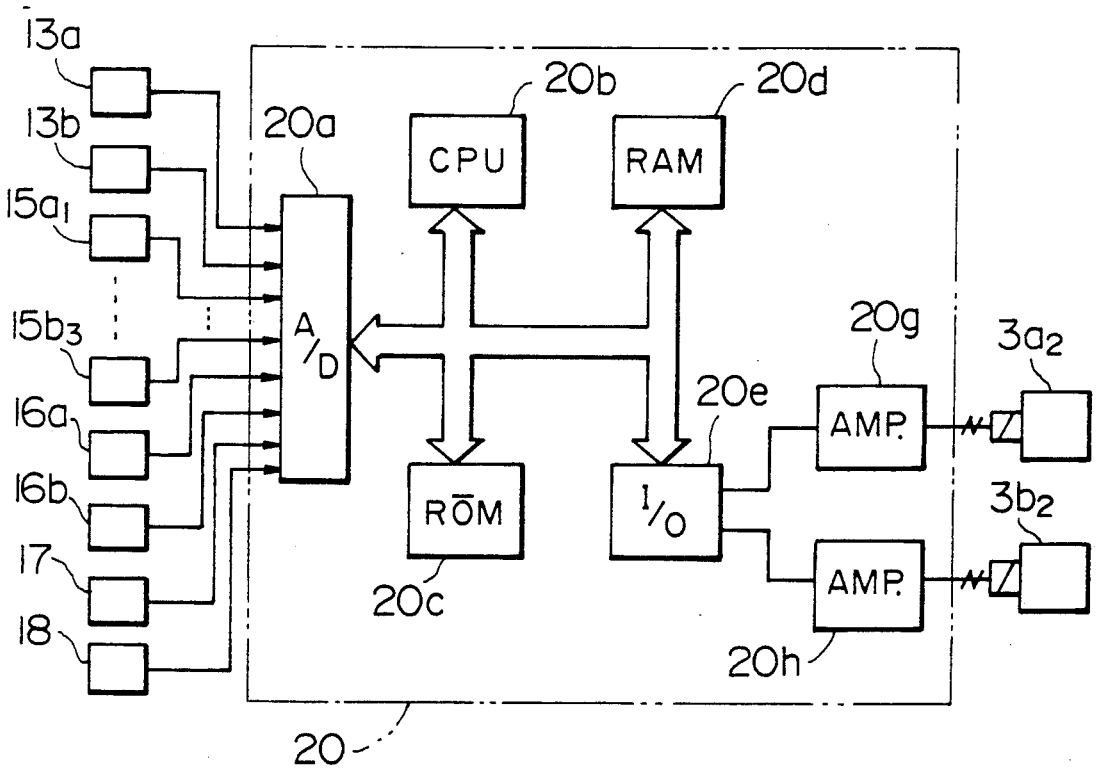
FIG. 2 is a view showing the structure of the control section shown in FIG. 1.

The controller 20 comprises a micro-computer and has, as shown in FIG. 2, an A/D converter 20*a* for the input, a central processing unit (CPU) 20*b*, a read only memory (ROM) 20*c* for storage of a control process program, a random access memory (RAM) 20*d* for temporary memory of numerical values in the process of the operation, an I/O interface 20*e* for the output, and amplifiers 20*g*, 20*h*.

The controller 20 converts the detection signals from the group of sensors 13*a*, 13*b*, 15$a_1$-15$b_3$, 16*a*, 16*b* and 17 and the command signal from the selection commander 18 into digital signals through the A/D converter 20*a*. In the CPU 20*b*, the operation is made using the digital signals in accordance with the control process program to provide a command value for controlling the displacement the hydraulic pumps. The command value is outputted from the amplifiers 20*g*, 20*h* through the I/O interface 20*e* to the control valves 3$a_2$, 3$b_2$ of the pump displacement control mechanisms 3*a*, 3*b*.

Figure 3:
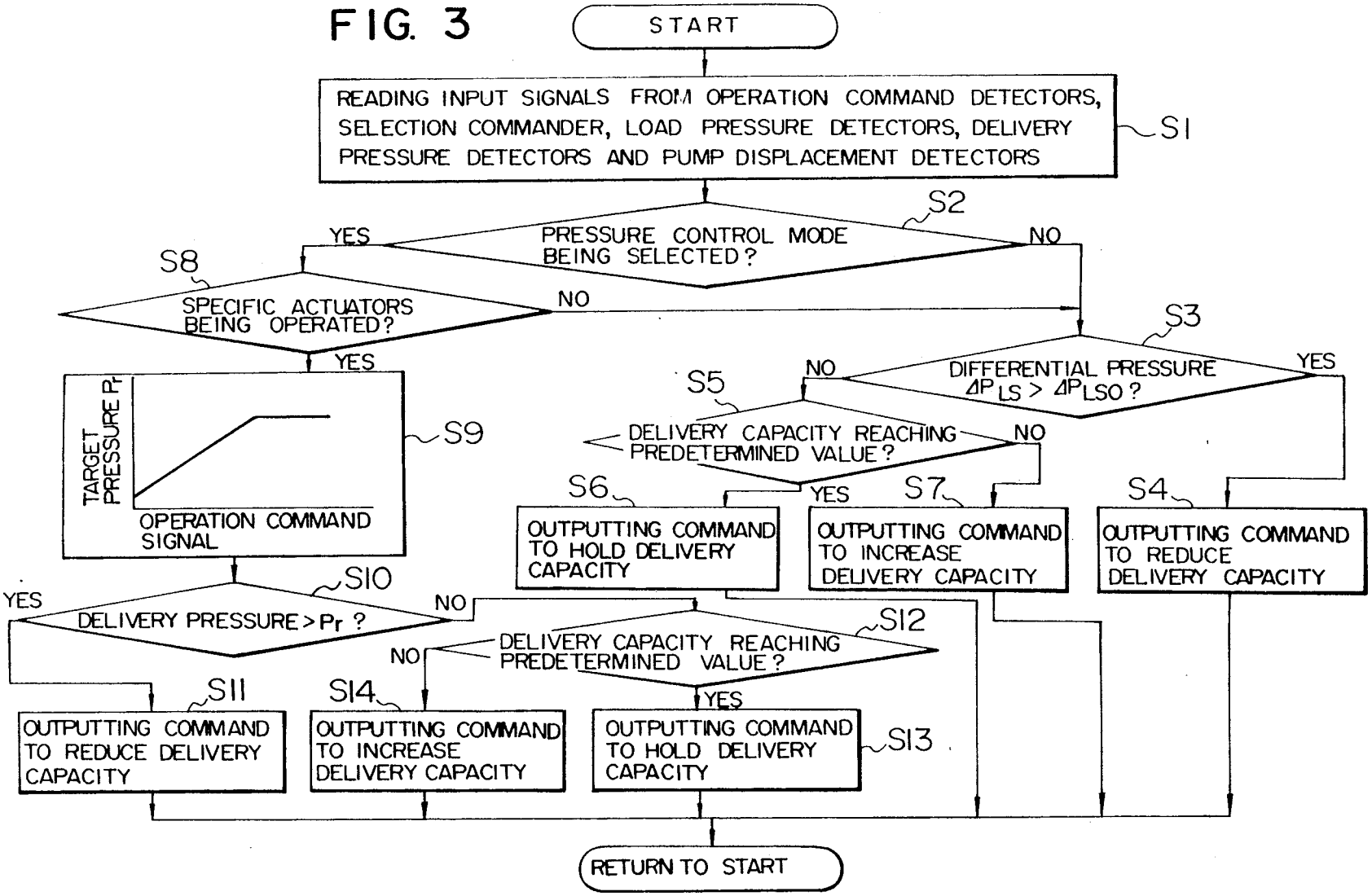
FIG. 3 is a flow chart for explanation of the operation of the apparatus shown in FIG. 1.

Subsequently, the operation of the present embodiment will be described in accordance with the flow chart of the control process program stored in the ROM 20*c* as shown in FIG. 3.

Assuming here that the operator manipulates one or more of the control levers 8$c_1$-8$d_3$ in order to drive the corresponding actuator or actuators 5$a_1$-5$b_3$, each of the corresponding hydraulic pilot valves 8$a_1$-8$b_3$ outputs a pilot pressure according to the amount and direction of manipulation of the corresponding control lever. The corresponding one or ones of the directional control valves 6$a_1$-6$b_3$ are operated by the force of the pilot pressure to open according to the amounts and directions of manipulation of the control levers. Thus, the hydraulic fluid of the hydraulic pumps 1*a*, 1*b* is fed to the corresponding one or ones of the actuators 5$a_1$-5$b_3$ through the corresponding ones of the pressure compensating valves 7$a_1$-7$b_3$ and the directional control valves 5$a_1$-5$b_3$. The quantity of the hydraulic fluid fed to each actuator is proportional to the opening area of an orifice in the corresponding one of the directional control valves 6$a_1$-6$b_3$, and the actuator is driven at a rate or speed proportional to the flow rate of the thus fed hydraulic fluid. In this case, when plural actuators are simultaneously driven for a combined operation, as the differential pressures across the directional control valves are kept constant by the pressure compensating valves 7$a_1$-7$b_3$, respectively, the hydraulic fluid delivered from the pumps 1*a*, 1*b* is divided in proportion to the ratio of the opening areas of the orifices of the corresponding directional control valves. Accordingly, concentration of the hydraulic fluid to the actuator of low load is prevented.

Meanwhile, the controller 20 has input, in a step S1 shown in FIG. 3, the detection signals from the pump displacement detectors 13*a*, 13*b*, the operation command detectors 15$a_1$-15$b_3$, the delivery pressure detectors 16*a*, 16*b* and the load pressure detector 17 as well as the command signal from the selection commander 18. Then, in a step S2, judgment is made whether the output from the selection commander 18 is the signal of selecting the pressure control mode. In case that the selection commander 18 is not operated and hence the pressure control mode is not selected, namely the load sensing control mode is selected, the process is advanced to a step S3.

In the step S3, judgment is made whether the differential pressure between an average of the delivery pressures of the hydraulic pumps 1*a*, 1*b* detected by the the delivery pressure detectors 16*a*, 16*b* and the maximum load pressure is larger than a specified value $\Delta P_{LSO}$. The above differential pressure will be designated hereinafter by $\Delta P_{LS}$. When the differential pressure $\Delta P_{LS}$ is higher than the specified value $\Delta P_{LSO}$, in a step S4, the command signal for reducing the pump displacement or delivery capacity is outputted to the control valves 3$a_2$, 3$b_2$ of the pump displacement control mechanisms 3*a*, 3*b*. On the other hand, when the differential pressure $\Delta P_{LS}$ is judged to be less than the specified value $\Delta P_{LSO}$ in the step S3, namely judgment is made that the pump delivery capacity is insufficient, in a step S5, the pump delivery capacity is judged once as to whether the same reaches a predetermined value, for instance the maximum capacity which is limited in view of the characteristic of a prime mover. This judgment is made by knowing, from the detection signals of the pump displacement detectors 13*a*, 13*b*, whether tilting of the swash plates 2*a*, 2*b* reaches a predetermined amount. Once the pump delivery capacity is judged in the step S5 to reach the predetermined value, a command signal is outputted in a step S6 for holding the displacement of the hydraulic pumps 1*a*, 1*b* pump as it is, because any further increase in the pump delivery capacity can not be expected. When the pump delivery capacity does not reach the predetermined value, however, the command signal for increasing the pump delivery capacity is output in a step S7 to the control valves 3$a_2$, 3$b_2$. Either the amount of the pump delivery capacity reduced by the process in the step S4 or that increased by the process in the step S7 is a unit amount which has been set beforehand. As described above, the drive control of the actuators is carried out in the load sensing control mode by repeating the above steps S1-S7.

On the other hand, when the operator of the hydraulic excavator wishes to slowly accelerate, for instance, the swing body, he manipulates the selection commander 18. The controller 20 judges the manipulation of the selection commander 18 or the selection of the pressure control mode in the step S2 in the course of the repetition of the above steps S1-S7. In this case, the process is advanced to a step S8.

In the step S8, the signals from the operation command detectors 15$a_1$-15$b_3$ are monitored to judge whether the control levers for specific actuators, for instance the control lever 8$d_3$ for the swing motor 5$b_3$, are manipulated. When the control levers for the specific actuators are not manipulated, the process advances to the step S3 so that the drive control is performed in the load sensing mode as described above. In case that the the step S8 makes the judgment that the control lever for the swing motor is manipulated, however, a target pressure Pr which corresponds to the operation command signal detected by the operation command detector $15b_3$ is sought in a step S9. In the present embodiment, the target pressure Pr is set beforehand in such a relation to the operation signal that the former increases as the latter increases as shown in FIG. 3. The function of this relation is stored in the ROM 20c shown in FIG. 2, and the target pressure Pr corresponding to the detected operation command signal is picked out from the ROM 20c.

Subsequently, in a step S10, a current delivery pressure is read out from the detection signals of the delivery pressure detectors 16a, 16b, and the thus read delivery pressure is judged as to whether the same is larger than the above target pressure Pr. When the current delivery pressure is higher than the target pressure Pr, a command signal is outputted, in a step S11, to the control valves $3a_2$, $3b_2$ of the pump displacement control mechanisms 3a, 3b so as to reduce the pump delivery capacity. On the other hand, when the delivery pressure is less than the target pressure Pr, the delivery capacity of the pumps 1a, 1b is judged in a step S12 as to whether the same reaches the predetermined value in the same manner as in the step S5. In the case that the delivery capacity reaches the predetermined value, a command signal is outputted at a step S13 to the control valves $3a_2$, $3b_2$ so as to hold the pump delivery capacity as it is. Contrarily, in case that the delivery capacity does not reach the predetermined value, the command signal for increasing the delivery capacity is outputted in a step S14 to the control valves $3a_2$, $3b_2$. The reduction and the increase of the delivery capacity by the process in the steps S11 and S14 are made by predetermined units of amount, respectively.

The process of the steps S9–S14 is repeated, unless the selection of the pressure control mode by the selection commander 18 is canceled, to perform the displacement control in the pressure control mode with respect to the hydraulic pumps 1a, 1b during driving of the swing motor $5b_3$. Under this control in the pressure control mode, the delivery pressure of the hydraulic pumps 1a, 1b is brought to a value which is proportional to the manipulation amount of the control lever $8d_3$, and the driving pressure of the swing motor $5b_3$ is also kept at a proper value correspondingly. More particularly, a small amount of manipulation of the control lever $8d_3$ causes the driving pressure of the swinging motor $5b_3$ to be low, so that the swinging motor $5b_3$ can accelerate slowly. Thus, the driving pressure of the swing motor is prevented from increasing up to the specified pressure of the relief valves $10c_1$, $10c_2$ for the swinging, which increase results in a sudden and rapid acceleration of the swing motor and which would occur if the control is made in the load sensing control mode.

Upon cancellation of the selection of the pressure control mode by the selection commander 18, this cancellation is judged or known through the process in the step S2, and then the control is returned to the normal load sensing control mode using the process of the steps S3–S7.

As has been described above, the present embodiment is so constructed that the operator of the hydraulic excavator can select at his discretion the load sensing control mode or the pressure control mode by using the selection control commander 18. Accordingly, it is possible to accurately move the actuator for driving such a body of large inertia as the swing motor in conformity with operator's intention.

Next, description will be made on another embodiment of the invention with reference with FIGS. 1 and 4.

The drive control apparatus of the present embodiment further has, in addition to the components of the first embodiment, a second selection commander 19 as shown by a two-dot chain line in FIG. 1, which selects a target value for the delivery pressure of the hydraulic pumps 1a, 1b and outputs a command signal.

Figure 4:
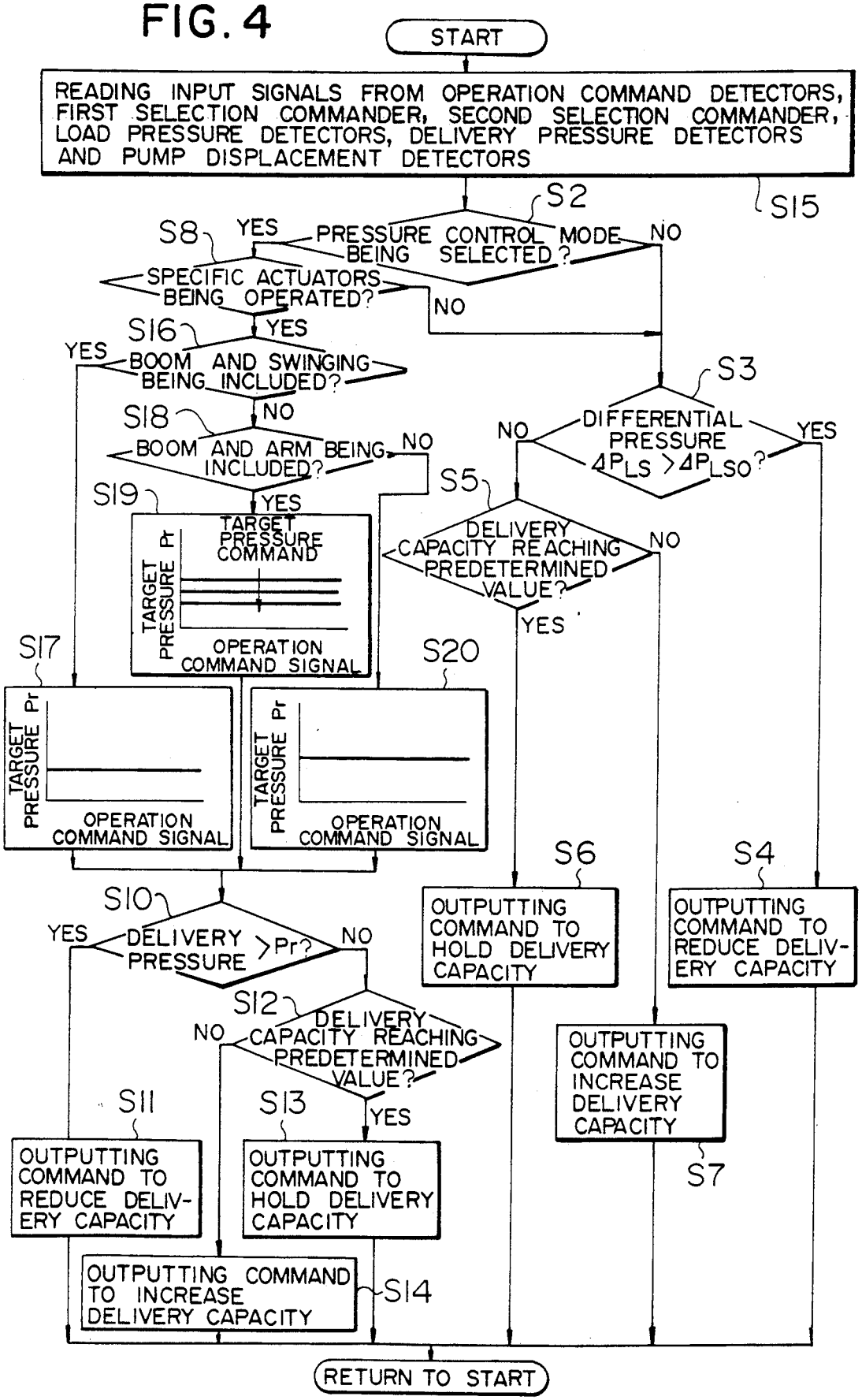
FIG. 4 is a flow chart for explanation of the hydraulic drive controlling apparatus for a hydraulic excavator in accordance with another embodiment of the invention.

In FIG. 4, in a step 15, the controller 20 receives the command signal from the second selection commander 19 in addition to the detection signals from the pump displacement detectors 13a, 13b, the operation command detectors $15a_1$1–$15b_3$, the delivery pressure detectors 16a, 16b and the load pressure detector 17, and the command signal from the selection commander 18. Then, in the step S2, judgment is made whether the output from the selection commander 18 is the command signal of selecting the pressure control mode. If the selection commander is not operated to select the pressure control mode, namely when the normal load sensing control mode is selected, the process is advanced to the step S3 to carry out the control in the normal load sensing control mode by using the process of the steps S3–S7. In case that the selection commander 18 is operated, however, the process is advanced to the step S8 where the control levers for specific actuators are judged as to whether they are manipulated. If the control levers for the specific actuators are not manipulated, the process is advanced to the step S3 to perform the control through the above described steps S3–S7.

Once judgment is made in the step S8 that the control levers for the specific actuators are manipulated, the process is advanced to a step S16. In the step S16, the specific actuators selected to be driven are judged as to whether they include the boom cylinder $5a_1$ and the swing motor $5b_3$. If the boom cylinder $5a_1$ and the swing motor $5b_3$ are included, for instance in the case of a combined operation of raising the boom and swinging, in a step S17, the target pressure Pr of a fixed value is set independently of the operation command signals detected by the operation command detectors, or the amounts of manipulation of the control levers for these actuators. The target pressure Pr has been determined beforehand to the optimum value for the combined operation of raising the boom and swinging, and is memorized in the ROM 20c shown in FIG. 2. Subsequently, the process of steps S10–S14 is executed to control the delivery capacity of the hydraulic pumps 1a, 1b. With this arrangement, even with the combined operation of raising the boom and swinging, the delivery pressure of the hydraulic pumps 1a, 1b are controlled so as to attain or coincide with the target pressure Pr, and the driving pressure of the actuators is kept constant correspondingly. As a result, the swinging motor $5b_3$ is accelerated at a rate proportional to the driving pressure, and the combined operation of raising the boom and swinging is done appropriately without any sudden acceleration.

When judgment in the step S16 is made such that the boom cylinder $5a_1$ and the swinging motor $5b_3$ are not included, the process is advanced to a step S18 to judge whether the specific actuators selected to be driven include the boom cylinder $5a_1$ and the arm cylinder $5b_1$. If the boom cylinder $5a_1$ and the arm cylinder $5b_1$ are included, for instance with a combined operation of the boom and the arm for leveling the ground, in a step S19, the target pressure Pr is set correspondingly to the command signal from the second selection commander 19. This target pressure Pr corresponds to the target value for the delivery pressure selected by the second selection commander 19, and is constant independently of the operation command signals as shown in FIG. 4. The function of this relation is also memorized in the ROM 20*c*.

Subsequently, the process of the steps S10–S14 is carried out likewise to control the delivery capacity of the hydraulic pumps 1*a*, 1*b*. By this control, even in the work for leveling the ground by means of the combined operation of the boom and the arm, the delivery pressure of the hydraulic pumps is controlled to the target pressure Pr, and the driving pressure is controlled correspondingly. Accordingly, a force for pressing the rear of the bucket against the ground does not become excessive, and the ground leveling work can be performed with a suitable pressing force in accordance with the selection of the second selection commander 19. In addition, this pressing force can be set to any magnitude by operating the second selection commander 19.

In the step S18, if the boom cylinder $5a_1$ and the arm cylinder $5b_1$ are judged not to be included, for instance when only the control lever $8d_3$ for the swing motor $5b_3$ is manipulated, the process is advanced to a step S20. In the step S20, the target pressure Pr of a fixed value is set independently of the operation command signal detected by the operation command detector $15b_3$. This value of the target pressure Pr is also memorized in the ROM 20*c* shown in FIG. 2. Subsequently, the process of the steps S10–S14 is carried out likewise to control the displacement capacity of the hydraulic pumps 1*a*, 1*b*. Under this control, the delivery pressure of the hydraulic pumps 1*a*, 1*b* is controlled to the target pressure Pr, and the driving pressure is controlled correspondingly to be kept constant. Consequently, the swing motor $5b_3$ is accelerated at a proper rate proportional to the driving pressure, while being prevented from suddenly and rapidly accelerating.

As has been described above, also in the present embodiment, the operator of the hydraulic excavator can select at his discretion the load sensing control mode or the pressure control mode by operating the selection commander, and appropriate driving of the swinging motor can be done. Additionally, in the combined operation of raising the boom and swinging, the optimum driving pressure for this combined operation is obtainable. Also, when the combined operation of the moving members including the boom and the arm, a target value for the delivery pressure can be set at operator's discretion from the outside of the apparatus by operating the second selection commander 19. Accordingly, when the ground leveling operation is desired, for instance, the bucket can be pressed against the ground with a proper force to perform the operation appropriately.

Incidentally, although in the above embodiments, the hydraulic excavator and its swing motor, boom cylinder and arm cylinder have been described as an example of a construction machine and its actuators, the construction machine and actuators are not limited solely to this example. The present invention is applicable to other construction machines and actuators thereof.

Further, in case that the actuators to be controlled always in the pressure control mode are fixed, selection commanders may be provided in the knobs of the control levers for these actuators so that each selection commander can operate upon operator's grasping of the corresponding knob. With such provision, the process made in the controller for judging whether the specific actuators are operated may be omitted.

Moreover, instead of respectively detecting the respective delivery pressures and the maximum load pressure to get the differential pressure therebetween in the controller, a differential pressure sensor may be provided to directly detect the differential pressure. The use of such differential pressure sensor is effective for improvement in the detection accuracy.

While a preferred embodiment has been set forth along with modifications and variations to show specific advantageous details of the present invention, further embodiments, modifications and variations are contemplated within the broader aspects of the present invention, all as set forth by the spirit and scope of the following claims.

What is claimed is:

1. A hydraulic drive controlling apparatus for a construction machine having a plurality of operation means to be manipulated by the machine operator, comprising:

at least one variable displacement type hydraulic pump for pumping hydraulic fluid to a delivery pressure;

a plurality of actuators responsive to respective operation means to be driven with the hydraulic fluid from said hydraulic pump and with respective load pressures;

directional control valves for controlling said plurality of actuators, said directional control valves being driven in accordance with amounts of manipulation of the operation means;

means for detecting the delivery pressure of said hydraulic pump;

means for selecting a maximum load pressure among the load pressures of said plurality of actuators;

first control means for controlling displacement of said hydraulic pump to bring a differential pressure between the delivery pressure and the maximum load pressure to a specified value in one mode of control;

second control means for controlling the displacement of said hydraulic pump to bring the delivery pressure thereof to a predetermined set target pressure value in another mode of control;

first command means for selecting a mode of control of the displacement of said hydraulic pump and outputting a corresponding command signal;

first selection means for selecting one of said first and said second control means for operation in one of the modes depending upon the command signal from said first command means; and wherein said second control means has first setting means for setting the target pressure value to increase as an amount of manipulation of the operation means increases.

2. The apparatus according to claim 1, wherein said second control means has second setting means for setting the target pressure value to a fixed value.

3. A hydraulic drive controlling apparatus for a construction machine having a plurality of operation means to be manipulated by the machine operator, comprising:

at least one variable displacement type hydraulic pump for pumping hydraulic fluid to a delivery pressure;

a plurality of actuators responsive to respective operation means to be driven with the hydraulic fluid from said hydraulic pump and with respective load pressures;

directional control valves for controlling said plurality of actuators, said directional control valves being driven in accordance with amounts of manipulation of the operation means;

means for detecting the delivery pressure of said hydraulic pump;

means for selecting a maximum load pressure among the load pressures of said plurality of actuators;

first control means for controlling displacement of said hydraulic pump to bring a differential pressure between the delivery pressure and the maximum load pressure to a specified value in one mode of control;

second control means for controlling the displacement of said hydraulic pump to bring the delivery pressure thereof to a predetermined set target pressure value in another mode of control;

first command means for selecting a mode of control of the displacement of said hydraulic pump and outputting a corresponding command signal;

first selection means for selecting one of said first and said second control means for operation in one of the modes depending upon the command signal from said first command means; and second command means for outputting a delivery pressure command signal, said second control means including setting means for setting the delivery target pressure value to vary depending upon the command signal from said second command means.

4. The apparatus according to claim 3, wherein said second command means command signal is different for operator manipulation of different operation means and said setting means of said second control means varies the delivery target pressure value to different values depending upon different operation means being manipulated.

5. A hydraulic drive controlling apparatus for a construction machine having a plurality of operation means to be manipulated by the machine operator, comprising:

at least one variable displacement type hydraulic pump for pumping hydraulic fluid to a delivery pressure;

a plurality of actuators responsive to respective operation means to be driven with the hydraulic fluid from said hydraulic pump and with respective load pressures;

directional control valves for controlling said plurality of actuators, said directional control valves being driven in accordance with amounts of manipulation of the operation means;

means for detecting the delivery pressure of said hydraulic pump;

means for selecting a maximum load pressure among the load pressures of said plurality of actuators;

first control means for controlling displacement of said hydraulic pump to bring a differential pressure between the delivery pressure and the maximum load pressure to a specified value in one mode of control;

second control means for controlling the displacement of said hydraulic pump to bring the delivery pressure thereof to a predetermined set target pressure value in another mode of control;

first command means for selecting a mode of control of the displacement of said hydraulic pump and outputting a corresponding command signal;

first selection means for selecting one of said first and said second control means for operation in one of the modes depending upon the command signal from said first command means; and second selection means for judging whether said operation means for a specific one of said actuators is manipulated, for selecting said second control means when said operation means for said specific actuator is manipulated, and for selecting said first control means when said operation means for the other actuators are manipulated.

6. The apparatus according to claim 5, wherein said second control means has first setting means for setting the target pressure value to increase as an amount of manipulation of the operation means increases.

7. The apparatus according to claim 6, wherein said second control means has second setting means for setting the target pressure value to a fixed value.

8. The apparatus according to claim 7, further including means responsive to said second selection means selecting said second control means for setting the target pressure value to a fixed value correlated to the specific one of said actuators.

9. The apparatus according to claim 6, including second command means for outputting a delivery pressure command signal, said second control means including third setting means for setting the delivery target pressure value to vary depending upon the command signal from said second command means.

10. The apparatus according to claim 9, further including means responsive to said second selection means selecting said second control means for setting the target pressure value to a fixed value correlated to the specific one of said actuators.

11. The apparatus according to claim 9, wherein said second command means command signal is different for operator manipulation of different operation means and said setting means of said second control means varies the delivery target pressure value to different values depending upon different operation means being manipulated.

12. The apparatus according to claim 11, further including means responsive to said second selection means selecting said second control means for setting the target pressure value to a fixed value correlated to the specific one of said actuators.

13. The apparatus according to claim 6, further including means responsive to said second selection means selecting said second control means for setting the target pressure value to a fixed value correlated to the specific one of said actuators.

14. The apparatus according to claim 5, including second command means for outputting a delivery pressure command signal, said second control means including third setting means for setting the delivery target pressure value to vary depending upon the command signal from said second command means.

15. The apparatus according to claim 14, wherein said second command means command signal is different for operator manipulation of different operation means and said setting means of said second control means varies the delivery target pressure value to different values depending upon different operation means being manipulated.

16. The apparatus according to claim 15, further including means responsive to said second selection means selecting said second control means for setting the target pressure value to a fixed value correlated to the specific one of said actuators.

17. The apparatus according to claim 5, further including means responsive to said second selection means selecting said second control means for setting the target pressure value to a fixed value correlated to the specific one of said actuators.

* * * * *